US009469509B1

(12) United States Patent
Myers et al.

(10) Patent No.: US 9,469,509 B1
(45) Date of Patent: Oct. 18, 2016

(54) END CAP AND SPREADER BAR SYSTEM AND METHOD FOR SIZING SAME

(71) Applicant: Clayton P. Myers, Webster, TX (US)

(72) Inventors: Clayton P. Myers, Webster, TX (US); Timothy I. McCullough, Katy, TX (US)

(73) Assignee: Clayton P. Myers, Webster, TX (US)

( * ) Notice: Subject to any disclaimer, the term of this patent is extended or adjusted under 35 U.S.C. 154(b) by 0 days.

(21) Appl. No.: 15/053,856

(22) Filed: Feb. 25, 2016

(51) Int. Cl.
*B66C 1/00* (2006.01)
*B66C 1/10* (2006.01)

(52) U.S. Cl.
CPC ..... *B66C 1/10* (2013.01)

(58) Field of Classification Search
CPC ..... B66C 1/12; B66C 1/24; B66C 1/18; B66C 1/10
USPC ..... 294/74, 81.1, 81.5
See application file for complete search history.

(56) References Cited

U.S. PATENT DOCUMENTS

| | | | | |
|---|---|---|---|---|
| 3,911,960 | A | 10/1975 | Flimon | |
| 4,215,891 | A * | 8/1980 | Thiele | B66C 1/125 294/74 |
| 4,397,493 | A | 8/1983 | Khachaturian et al. | |
| 4,538,849 | A * | 9/1985 | Khachaturian | B66C 1/12 294/81.1 |
| 4,842,314 | A | 6/1989 | Bellow | |
| 5,603,544 | A | 2/1997 | Bishop et al. | |
| 5,863,085 | A | 1/1999 | Khachaturian | |
| 6,079,760 | A | 6/2000 | Khachaturian | |
| 7,222,903 | B2 | 5/2007 | Tardiff | |
| 7,533,699 | B1 | 5/2009 | Cellemme et al. | |
| 7,967,352 | B2 | 6/2011 | Di Martino | |
| 8,011,391 | B2 | 9/2011 | Heritier et al. | |
| 8,118,091 | B2 | 2/2012 | Baker et al. | |
| 8,468,877 | B2 | 6/2013 | Molloy | |
| 9,132,993 | B1 * | 9/2015 | Dimartino | B66C 1/12 |
| 2009/0072561 | A1 | 3/2009 | Latham | |
| 2012/0160359 | A1 | 6/2012 | Baker et al. | |

FOREIGN PATENT DOCUMENTS

| | | |
|---|---|---|
| WO | WO2007/102002 | 9/2007 |

OTHER PUBLICATIONS

Tandemloc, Inc., Spreader Bar End Cap Assembly "End Caps" (AC25C) Type.
Tandemloc. Inc.. Standard Spreader Pipe for Use With AC25C End Eye Caps (AC22P).

* cited by examiner

*Primary Examiner* — Stephen Vu

(57) ABSTRACT

Several embodiments of an end cap are provided for use with a spreader bar system for distributing the lift force of a load across multiple points. The end cap comprises at least one lifting lug with the shackles positioned therethrough, along with at least one visual indicium for keeping a minimum of a 45 degree lift angle. Additionally, the end cap is provided with a pinch bolt system for easy assembly as well as a flat, horizontal foot plate located beneath the end cap for quick alignment. A four-point embodiment duplicates these features and positions two end caps at a 90 degree perpendicular angle atop a support plate. Additionally, a method of use is provided for pre-calculating maximum load so as to reduce the computation to a single chart.

17 Claims, 10 Drawing Sheets

*FIG. 9A*

Legend

Inside Diameter:

$ID := OD - 2 \cdot t_W \qquad ID = 6.07 \cdot in$

Section Modulus:

$S_p := \pi \cdot \frac{(OD^4 - ID^4)}{32 \cdot OD} \qquad S_p = 8.5 \cdot in^3$ Area of Section:

$A_{sect} := \frac{\pi}{4}(OD^2 - ID^2) \qquad A_{sect} = 5.58 \cdot in^2$

Radius of Gyration:

$r := \sqrt{\frac{I_p}{A_{sect}}} \qquad r = 2.25 \cdot in$

MOI:

$I_p := \pi \cdot \frac{(OD^4 - ID^4)}{64} \qquad I_p = 28.14 \cdot in^4$

Linear Weight:

$\omega_p := A_{sect} \cdot \rho \qquad \omega_p = 19.02 \cdot \frac{lbf}{ft}$

*Box 1*

For Compression Loads

$K := 1.0$ Effective Length Factor for pin-pin K=1

Slenderness ratio $S_e := \frac{K \cdot L_{sprd}}{r} = 98.2$

Column Slenderness ratio separating elastic and inelastic buckling $C_c := \sqrt{\frac{2 \cdot \pi^2 \cdot E}{F_y}} = 127.9$

*Box 2A*

For $Kl/r < C_c$

$$F_{a_1} := \frac{\left[1 - \frac{(S_e)^2}{(2 \cdot C_c^2)}\right] \cdot F_y}{N_d \cdot \left[1 + \frac{9 \cdot (S_e)}{40 \cdot C_c} - \frac{3 \cdot (S_e)^3}{40 \cdot C_c^3}\right]} = 7.22 \cdot ksi$$

*Box 2B*

For $Kl/r > C_c$

$$F_{a_2} := \frac{\pi^2 \cdot E}{1.15 \cdot N_d \cdot (S_e)^2} = 8.6 \cdot ksi$$

*FIG. 9B*

*Box 3*

Actual Column Stress: $f_a := \frac{P}{\frac{\tan(\beta)}{A_{sect}}} = 5.38 \cdot ksi$

*Box 4*

For Bending Loads

Allowable: $F_b := \frac{F_y}{N_d} = 11.67 \cdot ksi$

Bending moment due to weight of pipe $M_b := \frac{\omega_p \cdot L_{sprd}^2}{8} + X = 9633.52 \cdot lbf \cdot in$ (if an additional bending moment exists, then it can be input as x)

Actual Bending Stress $f_b := \frac{M_b}{S_p} = 1.13 \cdot ksi$

*Box 5*

Pipe Combined Stresses

Check $S_e$ vs. $C_c$

Allowable Stress $$F_a := \begin{cases} F_{a_2} & \text{if } \frac{K \cdot L_{sprd}}{r} > C_c \\ F_{a_1} & \text{otherwise} \end{cases}$$

$C_c = 127.89$ $\frac{K \cdot L_{sprd}}{r} = 98.2$ $F_a = 7.22 \cdot ksi$ $C_m := 1.0$ Euler Stress for a prismatic member divided by a design factor $$F_e' := \frac{\pi^2 \cdot E}{1.15 N_d \cdot S_e^2} = 8.6 \cdot ksi$$

*Box 6*

Unity Check

This number must be less than or equal to 1.0. If not, design parameters must be changed to comply with ASME BTH-1 2011. Both equations must be satisfied.

$$\frac{f_a}{\frac{F_y}{N_d}} + \frac{f_b}{F_b} = 0.56 \qquad \frac{f_a}{F_a} = 0.74 \qquad \frac{C_m \cdot f_b}{\left(1 - \frac{f_a}{F_e'}\right) \cdot F_b} = 0.26 \qquad \frac{f_a}{F_a} + \frac{C_m \cdot f_b}{\left(1 - \frac{f_a}{F_e'}\right) \cdot F_b} = 1$$

END CAP AND SPREADER BAR SYSTEM AND METHOD FOR SIZING SAME

FIELD

Embodiments within the scope of this disclosure relate, generally, to apparatuses, systems, and methods for fitting tubulars or pipes as spreader bars onto a shackle or lifting sling. This is accomplished through the use of an "end cap" fitting, which keeps the tubular in a compressive state and allows the tubular to be quickly and easily attached and disconnected from the lifting system without material alteration.

BACKGROUND

The use of spreader bar systems for lifting tubulars is well-known in the art. Examples of such spreader bar systems include, e.g., U.S. Pat. No. 4,397,493 to Khachaturian, et al., and U.S. Pat. No. 5,603,544 to Bishop, et al. The advantage of these systems is that they allow the force of a single-point lifting system, such as a shackle or hook, to be divided into multiple lifting points, thus avoiding the material stress and safety concerns associated with lifting a heavy load by a single point.

In order to adapt the shackle and spreader bar systems for various dimensions and weights, it is common to utilize an "end cap" system (also known as a compression cap system) for attaching spreader bars to the shackle. In this system, the spreader bar is fitted between two "end caps," which contain multiple orifices for connecting to both the lifting mechanism above and the load below. This allows for quick swapping of various sizes and weights of spreader bar as necessitated by the lift.

However, there are still several drawbacks to the state of the art in spreader bar lifting. Assembly of the end cap requires precise alignment of the end cap with the spreader bar, and often requires a tubular spreader bar to be physically altered (e.g., through spot welds or attachment holes) which can weaken the spreader bar's tolerance for metallurgical stresses.

Additionally, the process of determining the correct end cap fitting for use with a given load and span of weight to be lifted can often be time-consuming and prone to error when calculated by workers in the field. This can lead to an increased stress on the equipment and the risk of lift failure.

A need therefore exists for an end cap system in which both the method of selecting a properly rated and sized end cap and the physical method of fixing the end cap to a selected spreader bar are simplified to allow field personnel to more quickly and reliably rig-up lifting systems. Embodiments disclosed in the present invention meet these needs.

BRIEF DESCRIPTION OF THE DRAWINGS

In the detailed description of various, example embodiments within the scope of the present disclosure, reference is made to the accompanying drawings, in which:

FIG. 9 depicts a series of equations used to derive pre-calculated tolerances for the end cap described in the present invention One or more embodiments are described below with reference to the above-listed Figures.

DETAILED DESCRIPTION OF THE EMBODIMENTS

Before describing selected, example embodiments of the present disclosure in detail, it is to be understood that the present invention is not limited to the particular embodiments described herein. The disclosure and description herein is illustrative and explanatory of one or more example embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and disclose presently example embodiments to one of skill in the art, but are not intended to be manufacturing level drawings or renditions of final products, and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
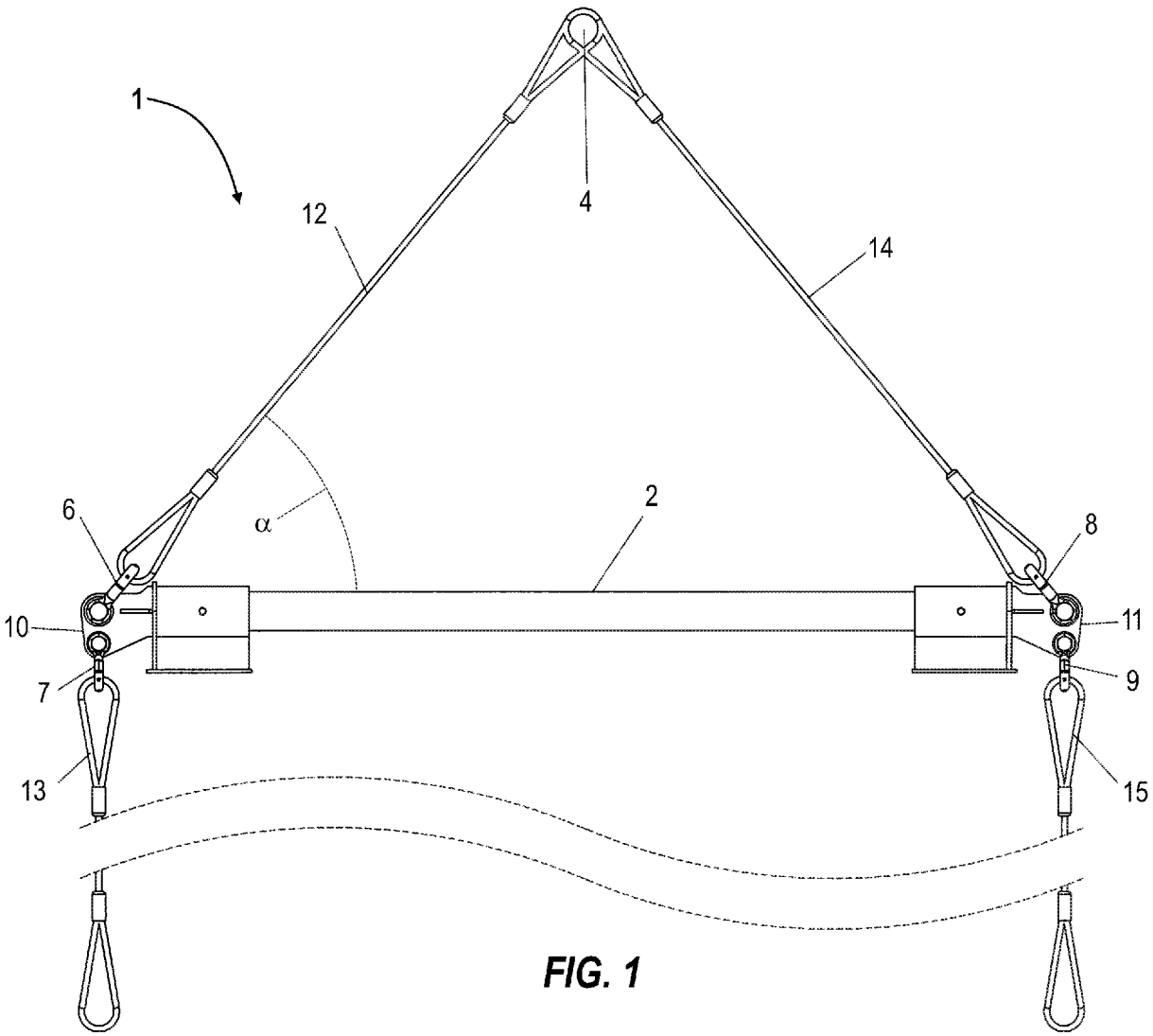
FIG. 1 depicts the overall layout of an embodiment of the end cap system in the context of connections to a single-point lift and a load to be lifted.

Referring now to FIG. 1, a lifting assembly 1 utilizing an embodiment of two end caps 10, 11 is illustrated. Lifting assembly 1 comprises spreader bar 2, lift point 4, and four shackles 6, 7, 8, 9. Shackles 6, 8 are connected by slings 12, 14 to lift point 4, while shackles 7, 9 are connected by slings 12, 14 to a weight to be lifted (not shown). Optimally, the relationship between the slings 12, 14 and the spreader bar 2 are defined by a minimum angle (also known as a fleet angle), shown as a, so as to keep the compressive force exerted on the spreader bar 2 within a maximum tolerance.

Figure 2:
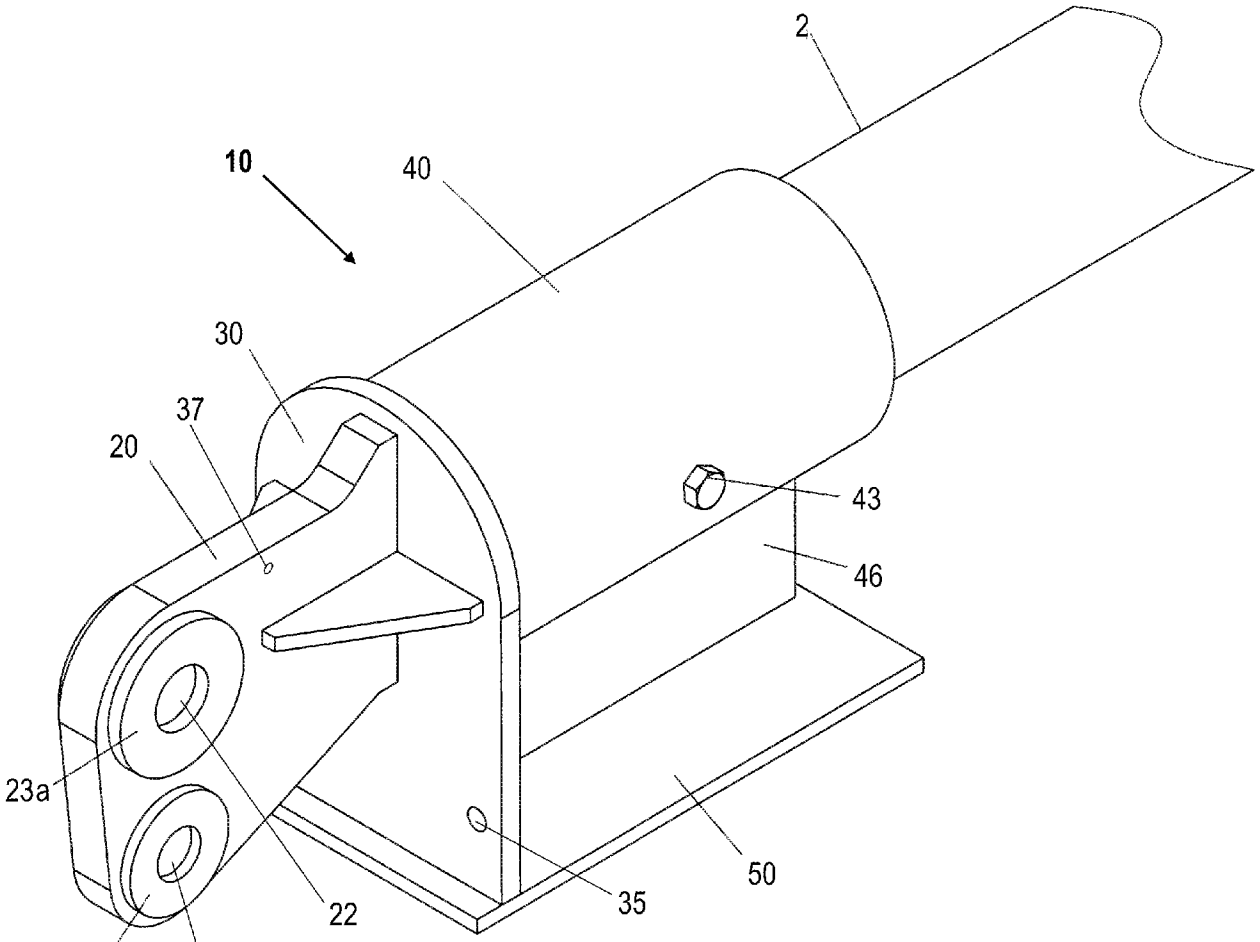
FIG. 2 depicts an embodiment of the end cap described in the present invention in perspective view.

Referring now to FIG. 2, the embodiment of the end cap 10 illustrated in FIG. 1 is shown in greater detail. End cap 10 comprises a load lug 20 extending longitudinally from a load plate 30. Load lug 20 in turn comprises two apertures 22, 24, which accommodate the shackles 6, 7 (not shown, illustrated in FIG. 1). To reinforce the strength of the material, apertures 22, 24 are reinforced through pairs of cheek plates 23A, 23B, and 25A, 25B, respectively (B plates not visible).

Load plate 30 faces a first end of spreader bar 2, which is compressed against load plate 30 and extends through a pipe retainer, also known as receptacle, 40, which extends from load plate 30 in the opposite longitudinal direction from load lug, also known as lifting lug, 20. In this embodiment, pipe retainer 40 is a hollow cylinder through which spreader bar 2 can be fitted. Pipe retainer 40 also comprises two apertures 42, 44 (not visible) through which two retaining bolts, also known as pinch bolts, 43, 45 (45 not visible) extend to compress against spreader bar 2. Retaining bolts 43, 45, allow the use of intact pipe for spreader bar 2, rather than pipe which has had holes torched through it, thereby compromising the material stress properties thereof.

Extending downward from pipe retainer 40 and normally to load plate 30 is leg plate 46, which terminates at foot plate 50. Leg plate 46 and foot plate 50 allow the end cap 10 to be easily mounted to spreader bar 2 in parallel with another end cap 11 (see FIG. 1).

Additionally, end cap 10 comprises two alignment references. Alignment aperture 35 is located through load plate 30 and serves to align two end caps (e.g., end caps 10 and 11 as depicted in FIG. 1) when in use. Angle reference 37, meanwhile, is located on load lug 20 and serves as a visual safety reference to keep the angle of the shackles 6, 8 and slings 13, 15 (depicted in FIG. 1) at a minimum effective angle.

In the present embodiment, angle reference 37 is depicted as a second aperture, however, it may be appreciated that other embodiments may include a simple surface reference (e.g., a reflector), or alternatively, a protruding physical stop. Any feature which serves to visually or physically mark the minimum effective angle (depicted as $\alpha$ in FIG. 1) between slings 13, 15 and spreader bar 2 may be utilized without departing from the scope of this invention. In an example embodiment, the minimum effective angle is a 45 degree angle, which is specifically referenced in the associated chart for this specific system but may differ in other embodiments.

Figure 3:
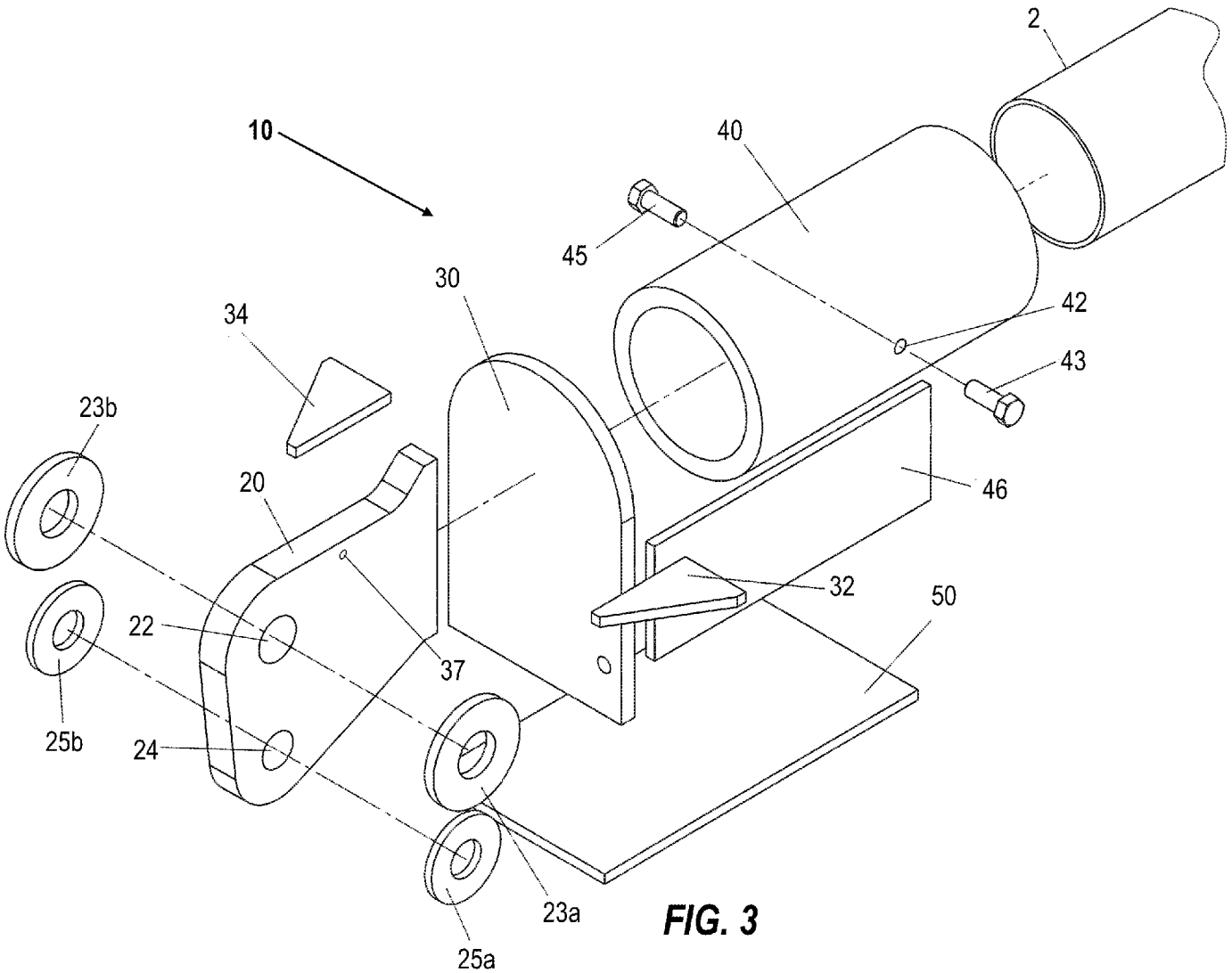
FIG. 3 depicts an embodiment of the end cap described in the present invention in an exploded view.

Referring now to FIG. 3, the embodiment of the end cap 10 illustrated in FIGS. 1-2 is shown in an exploded view. Retaining bolt 45, aperture 42, and cheek plates 23B, 25B are visible in this view. Additionally, braces 32, 34 are also illustrated, which brace load plate 30 against load lug 20.

Figures 4A, 4B, 4C, 4D:
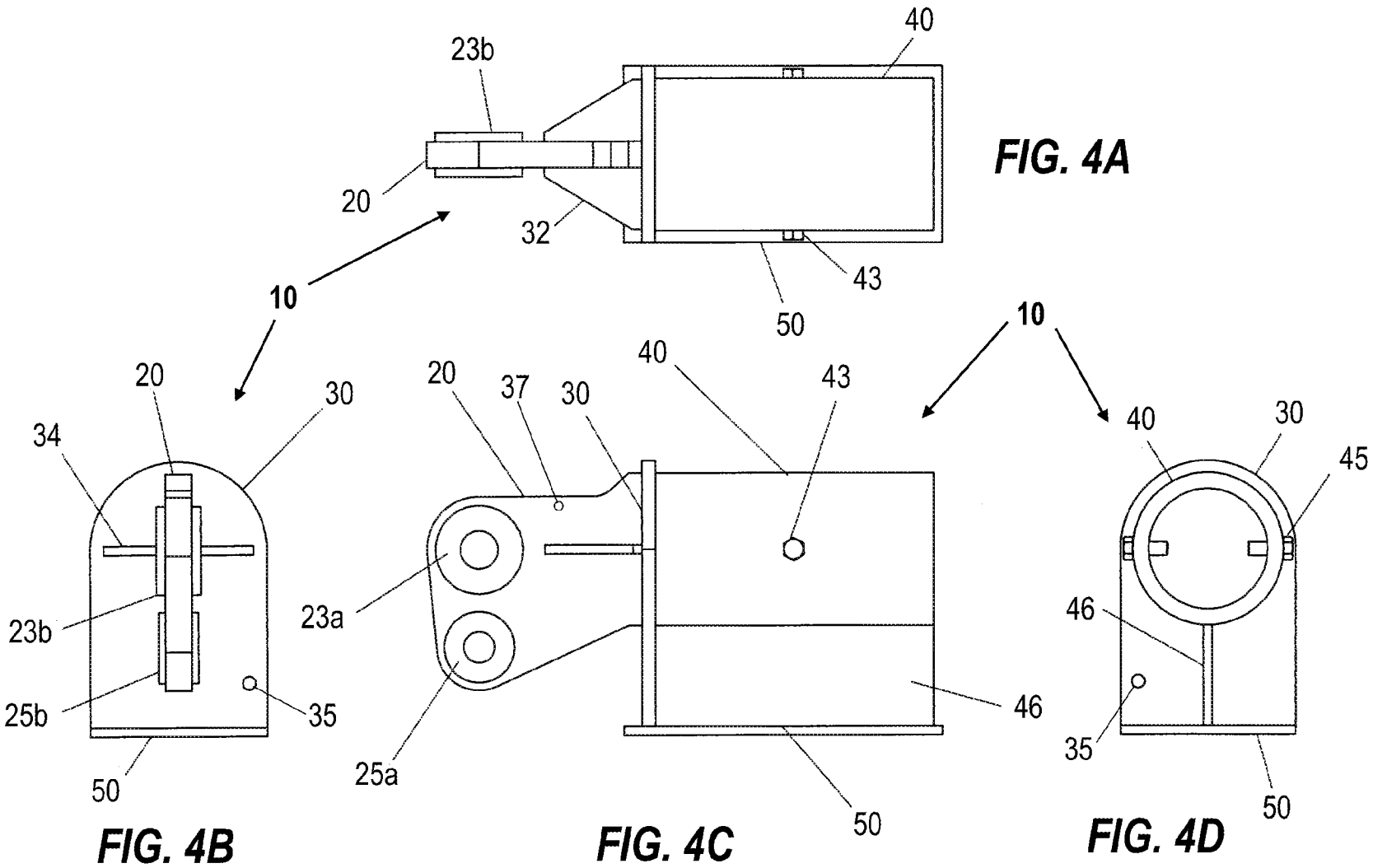
FIG. 4A depicts an embodiment of the end cap described in the present invention in an outward-facing longitudinal view.
FIG. 4B depicts an embodiment of the end cap described in the present invention in a plan (overhead) view.
FIG. 4C depicts an embodiment of the end cap described in the present invention in a side view.
FIG. 4D depicts an embodiment of the end cap described in the present invention in an inward-facing longitudinal view.

FIG. 4A-4D show the embodiment of the end cap 10 illustrated in FIGS. 1-3 in an overhead view (FIG. 4A), left side view (FIG. 4B), side-on view (FIG. 4C), and right side view (FIG. 4D). Significantly, the side views in FIGS. 4B and 4D illustrate how alignment aperture 35, which is located on load plate 30, may ensure that two end caps are properly aligned when mounted onto a spreader bar, as one end cap 10 will be in the position illustrated by FIG. 4B and the other in the position illustrated by FIG. 4D. Aperture 35 can also be used for a connection or "tag" line used with an adjoining rope or line to allow the spreader bar system to be guided from a safe distance from the load that is being lifted.

Figure 5:
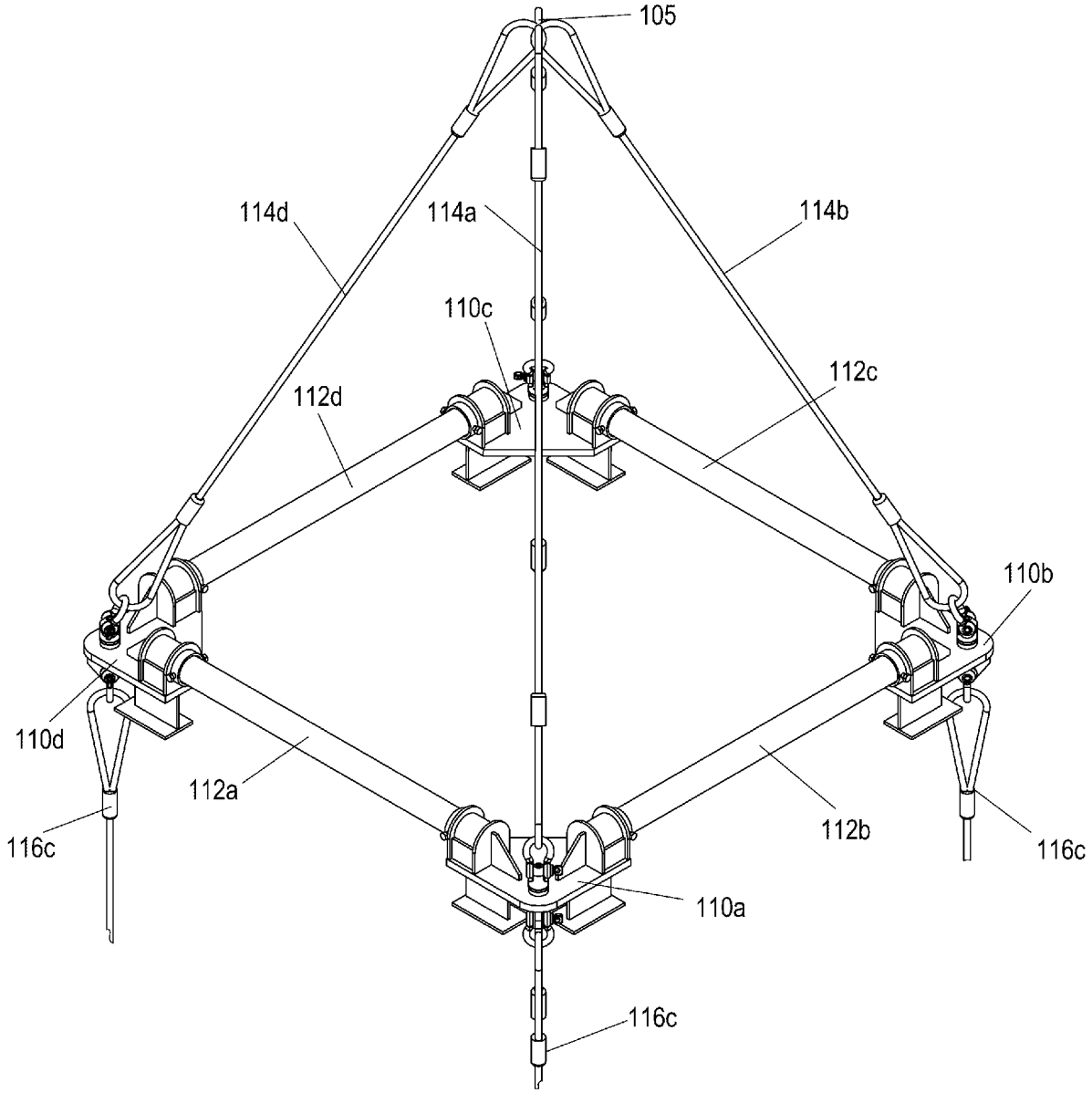
FIG. 5 depicts the overall layout of an embodiment of the end cap system in the context of connections to a multi-point lift and a load to be lifted.

While all of the embodiments thus shown are directed to two-point lifts, it can be appreciated that the principles of the invention can also apply to more elaborate lifting systems. FIG. 5 illustrates a perspective view of another embodiment of the invention: an end cap system directed to four-point lifts rather than two-point lifts.

Continuing with FIG. 5, the depicted embodiment comprises a plurality of end caps 110*a-d*, connected by a plurality of spreader bars 112*a-d*, wherein each end cap 110*a-d* is connected by an upper sling 114*a-d* (114*c* not visible) connecting to a common lift point 105, and a lower sling 116*a-d* (116*c* not visible) connected to a load to be lifted (not visible).

Figure 6:
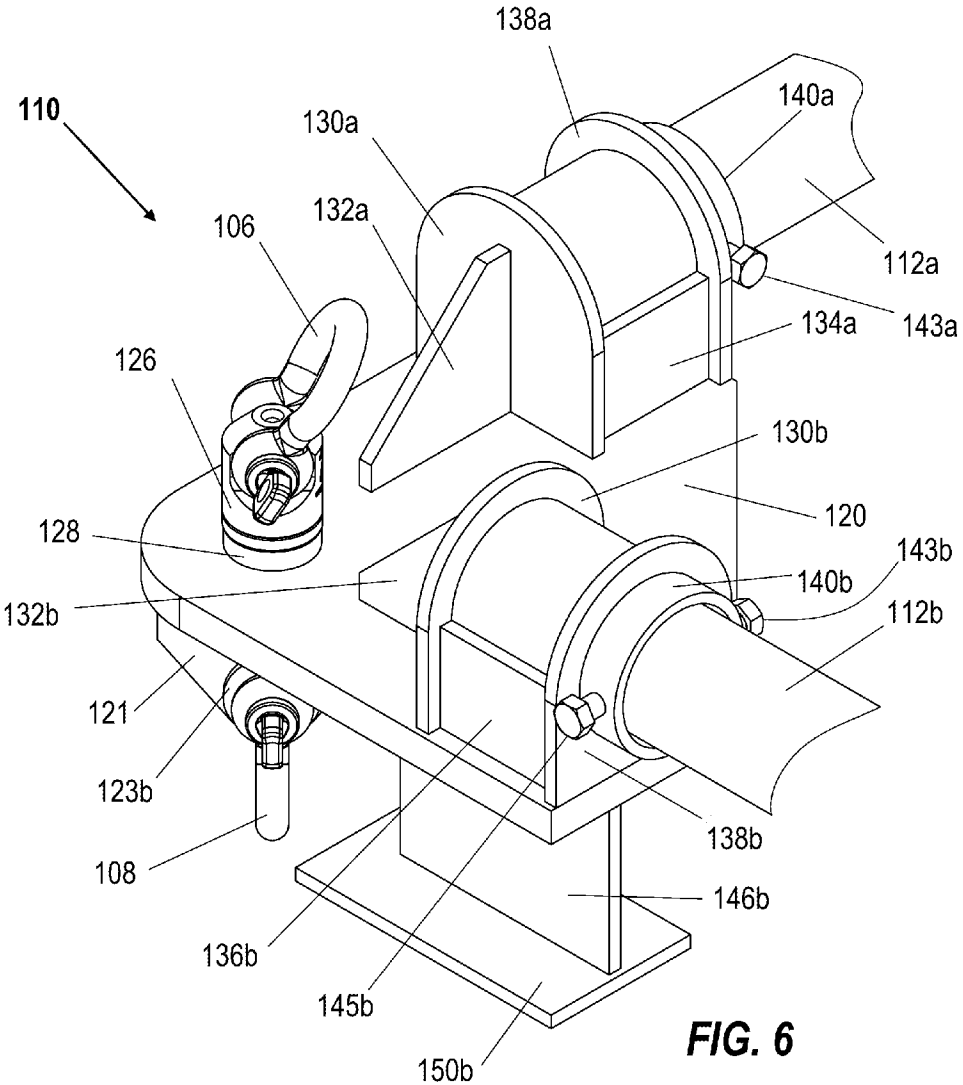
FIG. 6 depicts an embodiment of the end cap described in the present invention in perspective view.
Figure 7:
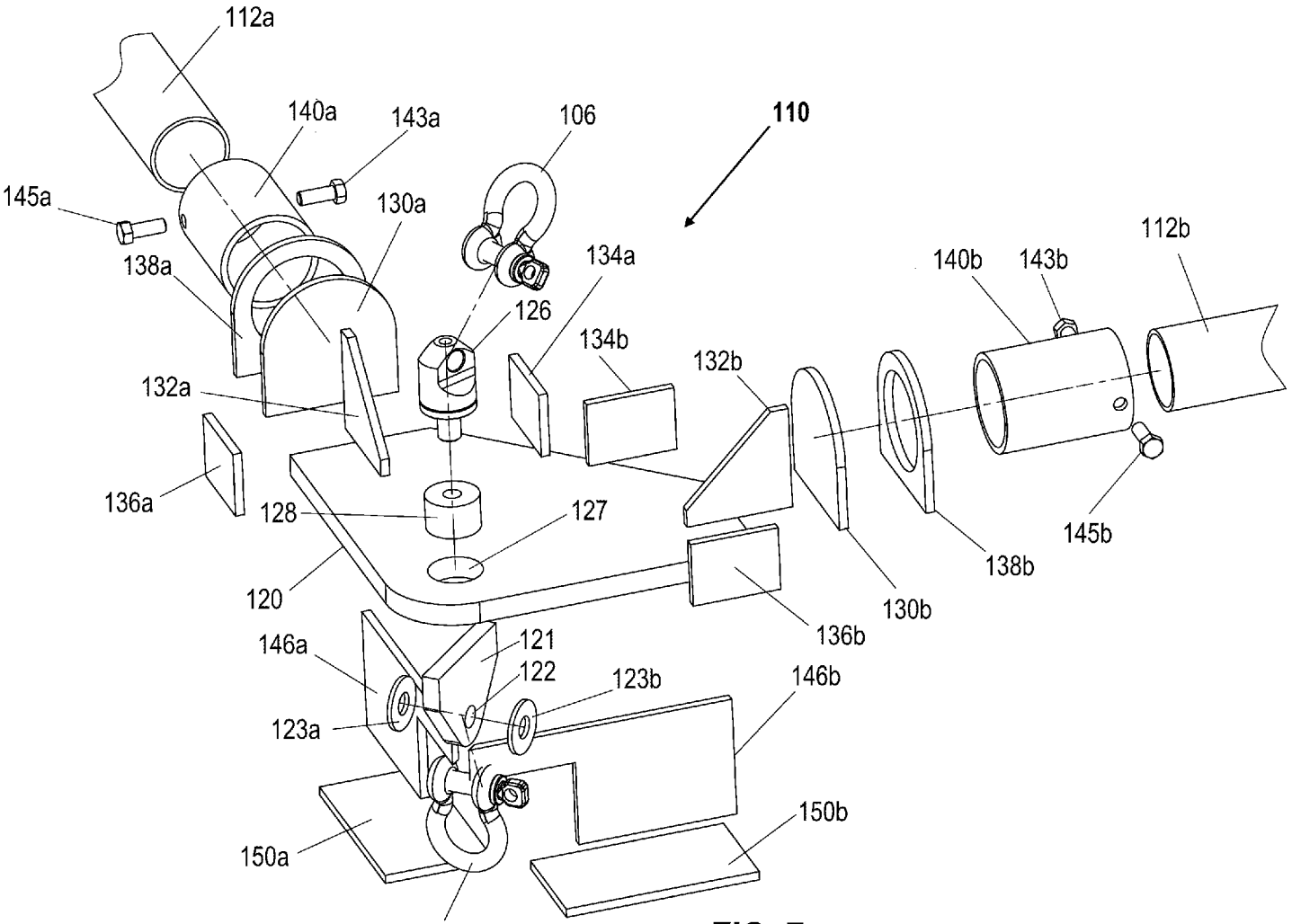
FIG. 7 depicts an embodiment of the end cap described in the present invention in an exploded view.
Figures 8A, 8B, 8C, 8D:
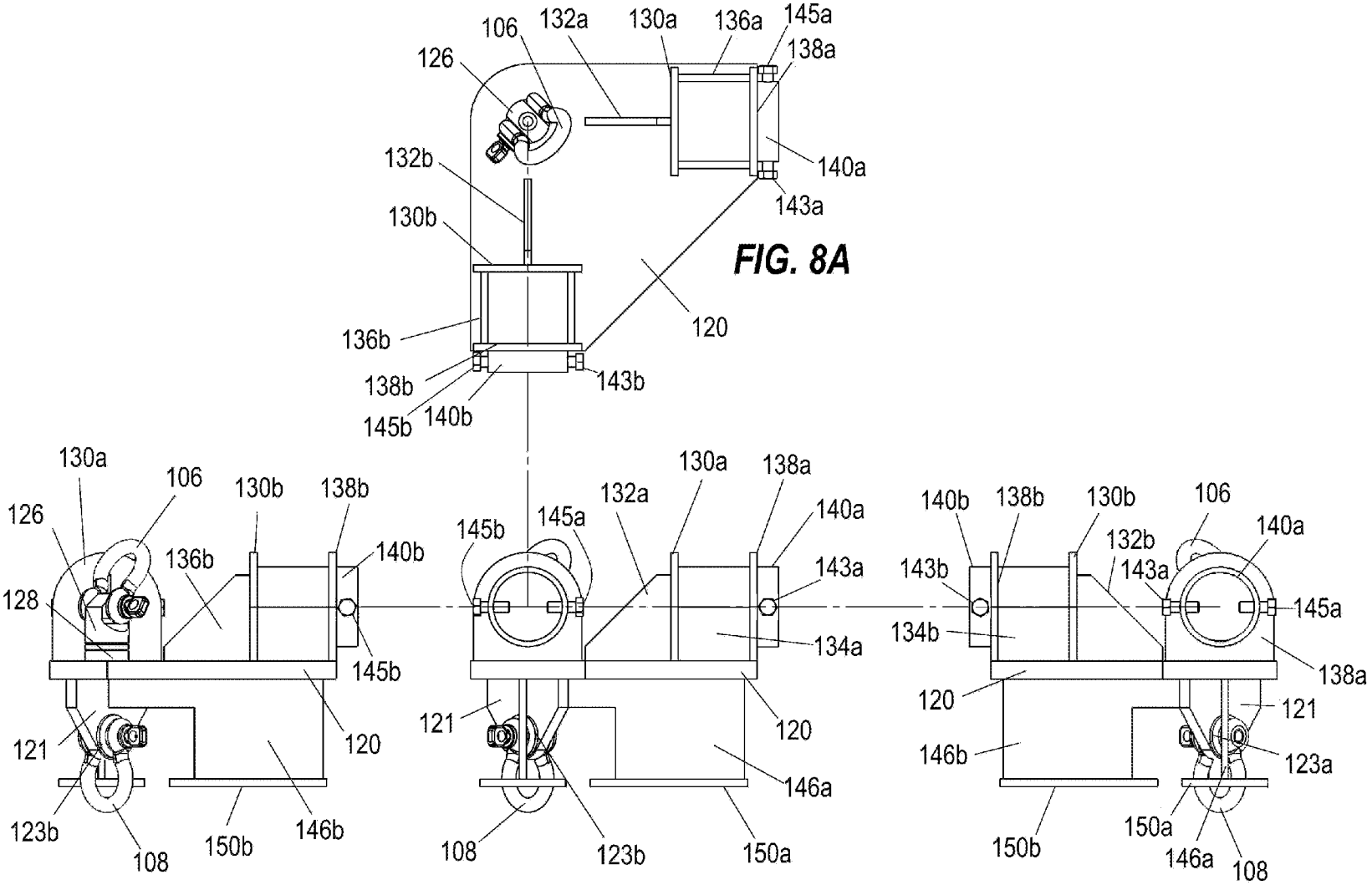
FIG. 8A depicts an embodiment of the end cap described in the present invention in a plan (overhead) view.
FIG. 8B depicts an embodiment of the end cap described in the present invention in a outward-facing longitudinal view.
FIG. 8C depicts an embodiment of the end cap described in the present invention in a side view.
FIG. 8D depicts an embodiment of the end cap described in the present invention in an inward-facing longitudinal view.

Turning now to FIG. 6 and FIG. 7, these drawings depict a perspective view and exploded view, respectively, of an embodiment of the four-point end cap 110. End cap 110 comprises mounting plate 120, and similar to the embodiment shown in FIG. 1-4, additionally comprises load plates 130*a* 130*b*, pipe retainers 140*a*, 140*b*, and feet plate 150*a*, 150*b* (150*a* not visible in FIG. 6). Pipe retainers 140*a*, 140*b* enclose spreader bars 112*a*, 112*b*, respectively. Pipe retainers 140*a*, 140*b* are supported in place by load plates 130*a*, 130*b*, as well as support braces 132*a*, 132*b* inside braces 134*a-b* (134*b* not visible in FIG. 6), outside braces 136*a-b* (136*a* not visible in FIG. 6), and mounts 138*a*, 138*b*. In addition to compression forces, pipe is fixed in place through retaining pinch bolts 143*a*, 143*b* and 145*a*, 145*b* (145*a* not visible in FIG. 6).

In this embodiment, upper and lower shackles 106 and 108 are connected to mounting plate 120 via two different means. Upper shackle 106 is connected to swivel ring 126, which is connected to mounting plate 120 via a ring bushing 128 seated in an aperture 127. Lower shackle 108 is connected to lifting lug 121, a structure that partially duplicates the structure depicted in the embodiment of FIGS. 1-4, with an aperture 122 through which shackle 108 can be attached and reinforced by cheek plates 123*a*, 123*b*.

Additionally, as with the embodiment depicted in FIGS. 1-4, this embodiment comprises two horizontal foot plates 150*a*, 150*b*, which, in turn, are connected to mounting plate 120 via two vertical leg plates 146*a*, 146*b*.

Turning now to FIGS. 8A-8D, the embodiment shown in FIGS. 5-7 is depicted in overhead, front, side, and rear views, similar to those of FIG. 4A-4D for the previous embodiment. (Note that FIGS. 8B and 8C can be distinguished by the position of lower shackle 108 with respect to the face-on foot plate 150*a* or 150*b*.)

Turning now to FIG. 9, a method of calculation is disclosed whereby the design parameters of various embodiments of the present invention can be pre-calculated from the load and span required in a lifting job. In this method, the load is purely compressive, i.e., the horizontal resultant is aligned with the pipe centerline. The exemplar calculations shown are for a load of 30 tons having a span of 20 ft to be lifted using a spreader bar of cylindrical pipe, made of standard ASTM A53B carbon steel.

The material parameters used in the calculation are as follows: Minimum yield ($F_y$, 35 ksi), density (p, 0.284 lbf/in3), modulus of elasticity (E, 29,000 ksi), outside diameter (OD, 6.625 in), wall thickness ($t_w$, schedule 40). Additionally, the spreaders in this calculation are presumed to be 9.75 inches in length, making the unbraced insert length ($L_{sprd}$) 220.5 in (span minus two spreaders).

From the above material parameters, several secondary parameters can be deduced, such as inside diameter (ID), area of section ($A_{sect}$), MOI ($I_p$), section modulus ($S_p$), radius of gyration (r), and linear weight ($\omega_p$), using the formulas at the top of FIG. 9. Additionally, a design parameter ($N_d$) is given in ASME BTH-1 2005, which for the purposes of the exemplar calculation is 3.0 (Category B).

Box 1, two compression load factors are calculated: a slenderness ratio, and a column slenderness ratio separating elastic and inelastic buckling, using the formulas given in Box 1. Depending on which of the two results is greater, the allowable column stress can be calculated using the formulas in Box 2A and Box 2B, while the actual column stress can be calculated using the formula in Box 3.

Meanwhile, the allowable and actual bending load stresses can be calculated using the formulas in Box 4. Then, the allowable and actual combined (Euler) stresses can be calculated utilizing the formulas in Box 5.

Finally, a two-part unity check is performed utilizing the values derived in Box 3, Box 4, and Box 5, and plugging them into the equations of Box 6.

While the exemplar calculations are given for a load of 30 tons having a span of 20 ft, it should be appreciated that these calculations may be performed in advance for any number of specific weights and spans. In addition, other parameters such as diameter, thickness, and weight of the end caps may also vary while still remaining within the scope of the present disclosure. In a method embodiment, the maximum tolerance for a given weights and span is pre-calculated and placed in a chart having weights and spans corresponding to different scales of end cap (e.g., diameter, thickness), for field workers to quickly and reliably select an embodiment of the present invention having dimensions which tolerate the lift stresses of a given task.

While various embodiments usable within the scope of the present disclosure have been described with emphasis, it should be understood that within the scope of the appended claims, the present invention may be practiced other than as specifically described herein.

What is claimed is:

1. An end cap for use with a spreader bar, the end cap comprising:

a receptacle shaped to receive the spreader bar, the receptacle comprising an outer end and at least one pinch bolt;

a load plate abutting the outer end of the receptacle, wherein the load plate is reinforced by at least one brace, wherein the load plate additionally comprises at least one aperture therethrough;

a lifting lug having at least a first aperture therethrough, wherein said aperture is shaped to receive a corresponding shackle; and a foot plate located below the receptacle, the load plate, and at least a portion of the lifting lug, wherein the foot plate is flat, and wherein the foot plate has a perpendicular connection with the load plate.

2. The end cap of claim 1, wherein the load plate is reinforced by at least two braces.

3. The end cap of claim 2, wherein one brace of the at least two braces connects the load plate to the lifting lug, and wherein the other brace of the at least two braces is alongside and parallel with the receptacle.

4. The end cap of claim 1, wherein the lifting lug additionally comprises a second aperture shaped to receive a second corresponding shackle.

5. The end cap of claim 4, wherein the lifting lug additionally comprises at least two cheek plates, wherein one of the at least two cheek plates is concentric to the first aperture, and wherein the other of the at least two cheek plates is concentric to the second aperture.

6. The end cap of claim 1, wherein the lifting lug additionally comprises at least one cheek plate located concentric to the first aperture.

7. An end cap for use with a plurality of spreader bars, the end cap comprising:

a first receptacle having a first attachment to a base plate, wherein the first receptacle terminates at a first load plate, and wherein the first receptacle is shaped to receive one spreader bar of the plurality of spreader bars;

a second receptacle having a second attachment to the base plate, wherein the second receptacle terminates at a second load plate, wherein the second receptacle is shaped to receive another spreader bar of the plurality of spreader bars, and wherein the second receptacle is oriented perpendicular to the first receptacle;

a first brace reinforcing the first attachment between the first receptacle and the base plate;

a second brace reinforcing the second attachment between the first receptacle and the base plate;

a first foot plate located below the first receptacle and parallel to the base plate;

a second foot plate located below the second receptacle and parallel to the base plate; and a lifting lug having at least a first aperture therethrough, wherein the first aperture is shaped to receive a corresponding shackle.

8. The end cap of claim 7, additionally comprising a first plurality of braces and a second plurality of braces, wherein the first plurality of braces reinforces the first attachment between the first receptacle and the base plate, and wherein the second plurality of braces reinforces the second attachment between the second receptacle and the base plate.

9. The end cap of claim 7, wherein the base plate additionally comprises a swivel ring shaped to receive another corresponding shackle.

10. The end cap of claim 9, wherein the swivel ring is attached to the base plate by means of a ring bushing located within a hole extending through the base plate.

11. The end cap of claim 7, additionally comprising a first mount extending upwards from the base plate, wherein the first receptacle extends through the first mount.

12. The end cap of claim 11, additionally comprising a second mount extending upwards from the base plate, wherein the second receptacle extends through the second mount.

13. A system of end caps for lifting a load with at least one spreader bar, the system comprising:

a plurality of end caps, and at least one spreader bar extending therebetween;

a plurality of lower shackles, wherein each respective lower shackle is connected to at least one end cap of the plurality of end caps, wherein the each respective lower shackle is connected to a plurality of lower slings, and wherein each respective lower sling is connected to the load;

a plurality of upper shackles, wherein each respective upper shackle is connected to the at least one end cap of the plurality of end caps, wherein the each respective upper shackle is connected to a plurality of upper slings, and wherein the plurality of upper slings converge at a lift point, wherein each end cap of the plurality of end caps each comprises a foot plate, wherein each respective foot plate of the plurality of end caps is aligned in a common plane, and wherein the common plane is parallel with the at least one spreader bar; and wherein each end cap of the plurality of end caps comprises at least one receptacle to receive the at least one spreader bar, and wherein each at least one receptacle comprises a pinch bolt therethrough fastening the at least one spreader bar into place.

14. The system of claim 13, wherein each end cap of the plurality of end caps additionally comprises a visual reference point, wherein the visual reference point is positioned on the each end cap at a position to define a minimum sling angle between the at least one spreader bar and the plurality of upper slings.

15. The system of claim 14, wherein the minimum sling angle is 45 degrees.

16. The system of claim 13, wherein the each at least one receptacle is reinforced by a plurality of braces.

17. The system of claim 13, wherein the each end cap of the plurality of end caps comprises an aperture therethrough, wherein at least two apertures of at least two of the each end cap of the plurality of end caps align to define a common line therethrough when the at least one spreader bar is inserted into the at least two apertures of the plurality of end caps, and wherein the common line is parallel with the at least one spreader bar.

* * * * *